United States Patent [19]

Gueret

[11] Patent Number: 4,738,559

[45] Date of Patent: Apr. 19, 1988

[54] DEVICE FOR BRAKING BETWEEN TWO PARTS MOUNTED FOR ROTATION RELATIVE TO ONE ANOTHER, AND A HOLDER FOR A COSMETIC PRODUCT INCORPORATING SAME

[75] Inventor: Jean-Louis H. Gueret, Paris, France

[73] Assignee: L'Oreal, Paris, France

[21] Appl. No.: 813,778

[22] Filed: Dec. 27, 1985

[30] Foreign Application Priority Data

Dec. 28, 1984 [FR] France ..... 84 20015
Nov. 19, 1985 [FR] France ..... 85 17044

[51] Int. Cl.[4] ..... A45D 40/06

[52] U.S. Cl. ..... 401/74; 401/68; 401/80; 401/86

[58] Field of Search ..... 401/55, 74, 80, 84, 401/54, 78, 79, 87, 68, 75, 77, 86; 188/83; 132/79 C, 88.7; 206/385; 222/184, 390, 542

[56] References Cited

U.S. PATENT DOCUMENTS

| | | | |
|---|---|---|---|
| 2,442,109 | 5/1948 | Anderson . | |
| 2,609,092 | 9/1952 | Braselton | 401/75 |
| 2,864,494 | 12/1958 | Wahle . | |
| 3,272,327 | 9/1966 | Busch | 401/78 |
| 3,380,795 | 4/1968 | Gruska | 401/78 |
| 3,620,632 | 11/1971 | Gruska | 401/78 |
| 3,623,821 | 11/1971 | Gould | 401/86 |
| 4,166,474 | 9/1979 | McArdle et al. | 132/88.7 |

FOREIGN PATENT DOCUMENTS

| | | | |
|---|---|---|---|
| 458203 | 7/1947 | Canada | 401/78 |
| 0070257 | 7/1984 | European Pat. Off. . | |
| 985750 | 7/1951 | France . | |
| 1109797 | 4/1968 | United Kingdom . | |
| 1390200 | 4/1975 | United Kingdom . | |
| 1426645 | 3/1976 | United Kingdom . | |

OTHER PUBLICATIONS

French Search Report, dated Aug. 29, 1985.

*Primary Examiner*—Richard J. Apley
*Assistant Examiner*—Franklin Gubernick
*Attorney, Agent, or Firm*—Cushman, Darby & Cushman

[57] ABSTRACT

A device for braking between two substantially coaxial parts mounted for rotation relative to one another comprises a casing connected for rotation with a first part and adapted to surround at least a portion of the second part, the casing having flexible friction surfaces driven by the casing and situated against the inside surface of the casing, these friction surfaces being adapted to rub permanently against the outside surface of the second part.

18 Claims, 2 Drawing Sheets

DEVICE FOR BRAKING BETWEEN TWO PARTS MOUNTED FOR ROTATION RELATIVE TO ONE ANOTHER, AND A HOLDER FOR A COSMETIC PRODUCT INCORPORATING SAME

FIELD OF THE INVENTION

The present invention relates to a device for braking between two substantially coaxial parts mounted for rotation relative to one another.

PRIOR ART

Brake devices of this kind have already been proposed for the particular purpose of providing more agreeable control of the rotation of the two parts relative to one another while preventing undesired rotation due to the two parts being freely rotatable relative to one another, such as would occur in the absence of such control.

OBJECT OF THE INVENTION

It is a principal object of the invention to provide a brake device complying better than hitherto with various practical requirements.

It is a further object to provide a brake device of simple, economical construction and which works smoothly.

SUMMARY OF THE INVENTION

According to the present invention there is provided a device for braking between first and second substantially coaxial mutually relatively rotatable parts wherein: the two parts have substantially the same diameter as one another and are disposed axially adjacent one another, said brake device comprising a casing connected for rotation with said first part and adapted to surround at least a portion of the second part, said casing containing flexible friction means driven by said casing and situated against the inner surface of the casing, and said friction means being adapted to rub permanently against the outer surface of the second part.

The flexible friction means generally engage zones of contact of the outer surface of the second part.

The casing preferably has a polygonal contour.

The flexible friction means may comprise an elastic belt extending over the periphery of a polygon and coming into contact with the outer surface of said second part, in the zones of contact.

Advantageously the elastic belt is an elastic ring of the O-ring type, particularly of elastomeric material.

The first and second parts generally have a circular cross-section and the casing may have a square shape, the inner edge of the elastic belt extending substantially along the square circumscribed on the circular cross-section of the second part, while the outer edge of this elastic ring bears against the inner surface of the square cross-section of the casing.

Mounting means situated at the apices of a polygon are disposed inside the casing, while the elastic belt is engaged around these mounting means.

The casing may be closed by a cover, particularly a polygonal cover, which has an opening for the passage of the second part, this cover being provided, towards each of its corners, with feet directed towards the bottom of the casing and intended to be situated inside the casing, these feet constituting mounting means for the elastic belt which is passed around them.

More advantageously the flexible friction means comprise a skirt of flexible material extending from the cover towards the bottom of the casing, said skirt being in contact with the outer surface of the second part in certain zones.

The skirt preferably comprises a prismatic surface having substantially plane faces which come into contact with the second part.

The casing has a generally prismatic shape and a polygonal contour, the prismatic surface of the skirt then being substantially parallel to the casing.

On its inner surface the skirt may have swellings adapted to come into contact with the surface of the second part, particularly for the purpose of increasing the braking between the two parts. These swellings are generally provided in the central region of the faces of the skirt.

In this embodiment the cover may have a polygonal shape and be provided towards each of its corners with feet directed towards the bottom of the casing and intended to be situated inside the casing. The skirt is then composed of a band of flexible material having a closed contour and separate from the cover, this band being disposed around the feet of the cover. The contour of the band is preferably preshaped in such a manner as to correspond to a contour supported on the feet of the cover, thus facilitating the positioning of the skirt.

It is also possible for the skirt to be integral with the cover, the skirt and cover being an integral moulding.

The casing has a transverse bottom and means for locking the first part relative to the casing, these locking means being situated outside the contour of the first part, against the inside wall of the casing.

When the casing has a prismtic shape, the means for locking the first part may be in the form of radially inwardly projecting bosses provided in the dihedra of the casing wall, against the bottom of the casing.

The invention furthermore provides a holder for a cosmetic product, incorporating a braking device of the invention wherein said first part consists of the operating button of the holder and said second part consists of the sheath of the holder, said casing surrounding the base of the sheath situated near the operating button. The cosmetic product holder may be a lipstick holder.

BRIEF DESCRIPTION OF THE DRAWINGS

In order that the present invention may more readily be understood the following description is given, merely by way of example with reference to the accompanying drawings, in which.

DESCRIPTION OF THE PREFERRED EMBODIMENTS

Figure 1:
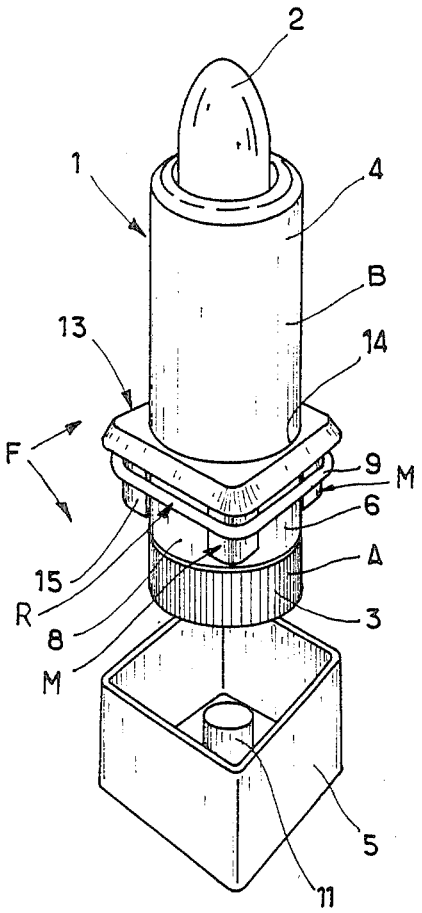
FIG. 1 is an exploded perspective view of a brake device according to the invention, applied to a lipstick holder.
Figure 2:
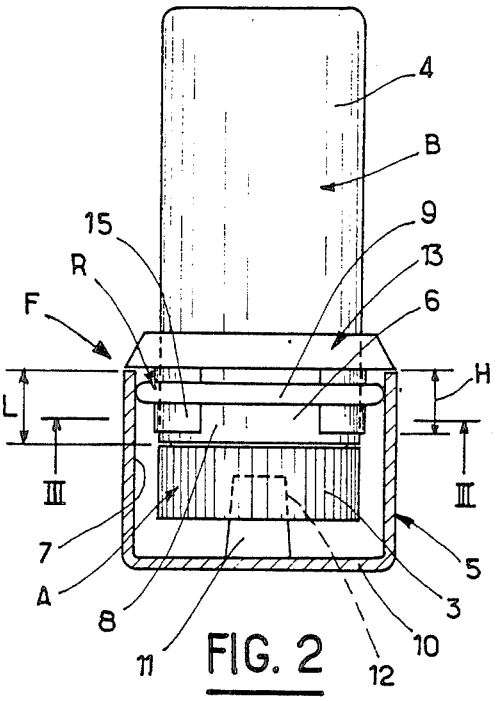
FIG. 2 is a section taken on the line II—II of FIG. 3, showing the device mounted on the holder.
Figure 3:
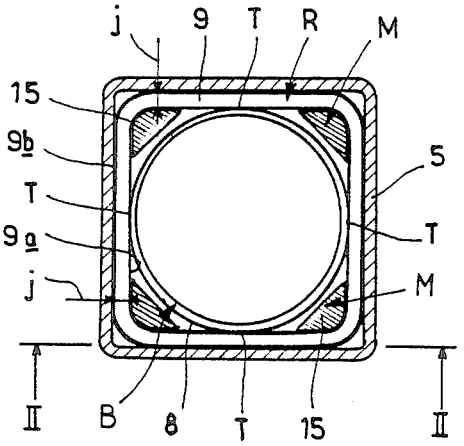
FIG. 3 is a partial schematic section taken on the line III—III of FIG. 2.

Referring now to FIGS. 1 to 3, there can be seen a device F for braking between two substantially coaxial parts A, B mounted for rotation relative to one another.

In the particular example shown in the drawings, the brake device F is applied to a cosmetic product holder 1, more particularly a lipstick holder. The lipstick 2, which is partially extracted, can be seen in FIG. 1.

The first part A is composed of the operating button 3 for extracting and retracting the lipstick 2, while the second part B is the sheath 4, generally made of metal, of the holder 1. The button 3 and the sheath 4 are coaxial circular cylinders of substantially the same diameter; the two parts A and B are disposed axially one behind the other.

The brake device F comprises a casing 5 non-rotatably connected to the first part A, that is to say the button 3. This casing 5 surrounds a part 6 of the second part B, that is to say the sheath 4. In the example envisaged, the part 6 comprises an entire peripheral zone of the sheath 4 axially spaced from but near to the button 3. In some cases the casing 5 might extend peripherally over only a fraction of this zone, that is to say it might extend only over an arc of the circumference of the casing cross-section.

Inside the casing 5 are flexible friction means R situated between the inner surface 7 of the casing and the outer surface 8 of the sheath 4. These friction means R, which are connected for rotation with the casing 5, are adapted to rub permanently against the outer surface 8 of the second part 4, and thus to effect the braking.

It is advantageous for the mounting means M to be disposed inside the casing 5 and to be situated at the apices of the polygon, namely by a square in the example shown in the drawings, while an elastic belt 9 is engaged around these mounting means M. As can be seen in FIG. 3, the belt 9 extends over the perimeter of the polygon, that is to say the perimeter of the square in the case of the example illustrated. The inner edge of the belt 9 comes into contact with the outer surface 8 of the sheath 4 at four zones T, each zone being situated substantially midway between two consecutive ones of the mounting means M.

The casing 5 also has a polygonal contour and is a prism having a square cross-section; it is provided with a transverse bottom 10 fixed to the walls of the casing, and has the opposite end open. The bottom 10 is provided internally with a central funnel 11, particularly one of frustoconical shape, which is adapted to engage in a socket 12 provided in the centre of the button 3 to lock the button 3 against rotation to the casing 5.

The open end of the casing is intended to be closed by a polygonal cover 13, which is square in this example, this cover 13 having a central opening 14 permitting the free passage of the sheath 4.

Towards each of its corners, but slightly set back from these corners in the direction of the diagonals of the square, and perpendicular to the cover 13 are feet 15 which are directed towards the bottom 10 and inside the casing 5. When this cover is in place on the casing 5, the feet 15 are directed at right angles to the bottom 10 which is itself parallel to the cover 13.

As can be seen in FIG. 3, the cross-section of each foot 15 has substantially the shape of a right-angled isosceles triangle in which the right angle has been rounded off as an arc of a circle with its convexity facing outwards. The two sides of the triangle are parallel to the adjoining faces of the casing 5, while the hypotenuse of the triangle is at right angles to the diagonal of the cross-section of the casing 5 at that corner. The distance between on the one hand the two plane faces of the feet 15, which face the casing 5 and which form the right angle of the cross-section, and the inside surface of the adjoining walls of the casing 5 is designated j in FIG. 3. The axial extent H of the feet 15 is slightly smaller than the axial distance L over which the casing 5, once it is placed in position, covers the sheath 4 (see FIG. 2). The distance L may be of the order of 10 mm.

An elastic belt 9 is engaged around these feet, as can clearly be seen in the drawings. The feet 15 take up position outside the surface 8, in the spaces existing between the corners of the casing 5 and this surface 8, as can be seen in FIG. 3.

The belt 9 is advantageously an elastic O-ring having a circular cross-section, and is particularly made of elastomeric material. This belt 9 lightly grips the casing 5, and the outer surface of the feet 15. In other words, the width of the cross-section of the ring 9, that is to say, in the case of an O-ring, the diameter of the cross-section, is greater than the distance j.

The outer edge 9*b* of the ring 9 is applied against the inner surface of the casing 5. As already explained the inner edge 9*a* extends over the perimeter of a square which is at least as large as that circumscribed on the circular cross-section of the surface 8. As a rule, in order to have more definite contact between the ring 9 and the surface 8, in the free state the perimeter of the inner edge 9*a* of this ring is inside the perimeter of the square circumscribed on the surface 8. Thus, on assembly, those parts of the ring 9 which are situated in the zones T are slightly crused between the surface 8 and the walls of the casing 5, in such a manner that the zones of contact T are not simply punctiform but extend over an arc of a circle.

The assembly and the operation of the brake device according to the invention can be seen immediately from the explanations given above.

The funnel 11 of the casing 5 is force-fitted in the socket 12 in the button 3, in order to hold the casing 5 and the button 3 for conjoint rotation. The elastic ring 9 is engaged around the feet 15 of the cover 13 in such a manner as to be situated substantially midway along the length of the feet 15. The cover 13 is engaged over the sheath 4 and is slid towards the casing 5, while the feet 15 are suitably oriented so as to take up position in the corners of the casing 5.

Sufficient force is applied in bringing the cover 13 and the bottom 10 towards one another to ensure that the elastic ring forming the belt 9 engages in the casing and is gripped on the one hand between exterior of each of the feet 15 and the inside surface of the casing 5, and on the other hand, at the zones T between the sheath 4 and the casing 5.

It can be noted that because of the friction exerted by the ring 9 on the sheath 4, the force needed to bring the cover 13 and the casing 5 towards one another results in an axially directed force driving the sheath 4 towards the button 3, which is already locked axially on the funnel 11. Axial play between the sheath 4 and button 3 can thus be taken up.

When the cover 13 has been suitably pressed into position it becomes held on the casing 5 by the grip of the belt 9 in the spaces existing betwen the feet 15 and the casing 5.

In order to control the extraction or retraction of the lipstick 2, the sheath 4 is held in one hand and the casing 5 is turned relative to the sheath 4 by the other hand so as to effect rotational driving of the button 3 in the desired direction.

During this rotational movement, friction is set up in the four zones T between the belt 9 held by the casing 5 and the surface 8 of the sheath 4 which is thus restrained against free rotation.

The friction of the belt 9, particularly in the case of a ring of elastomeric material rubbing against a metal surface 8, ensures smooth operation similar to hydraulic sliding.

Referring now to FIGS. 4 to 7, other forms of construction can be seen for the brake device F between two substantially coaxial parts A, B mounted for rotation relative to one another.

Figure 4:
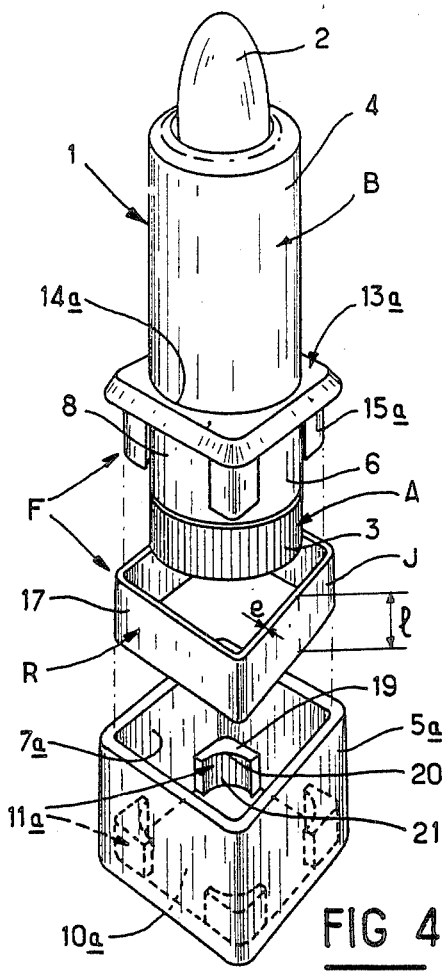
FIG. 4 is an exploded perspective view of another form of construction of a brake device according to the invention, applied to a lipstick holder.
Figure 6:
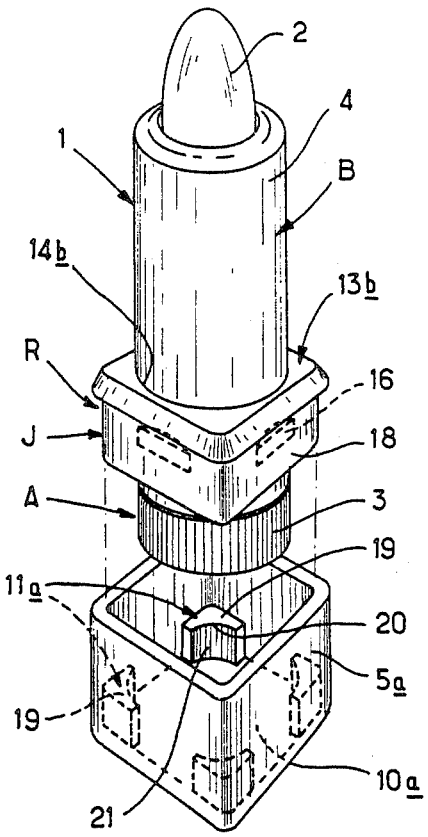
FIG. 6 is an exploded perspective view of another form of construction of the brake device in course of assembly, applied to a lipstick holder.

In this example the brake device F is again applied to a cosmetic product holder 1, more particularly a lipstick holder. The partially extracted lipstick 2 is shown in FIGS. 4 and 6.

Elements or parts identical or similar to elements already described in connection with the preceding Figures are given the same reference numerals or letters, and their description will not be repeated.

The brake device F comprises a casing 5*a* fixed for rotation with the first part A, that is to say with the button 3. This casing 5*a* is adapted to surround at least a portion of the second part B, that is to say of the sheath 4.

In the example envisaged, the portion 6 consists of an entire peripheral zone of the sheath 4 situated axially adjacent the button 3. The casing 5*a* generally has a prismatic shape as shown in the drawing, and has a polygonal contour.

In the particular example shown in the drawing, the casing 5*a* has the shape of a prism with a square base.

Figure 5:
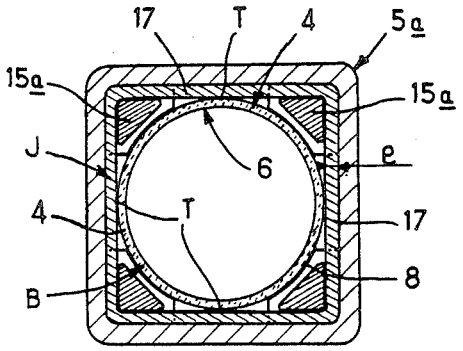
FIG. 5 is a cross-section of the brake device shown in FIG. 4, mounted on the holder.
Figure 7:
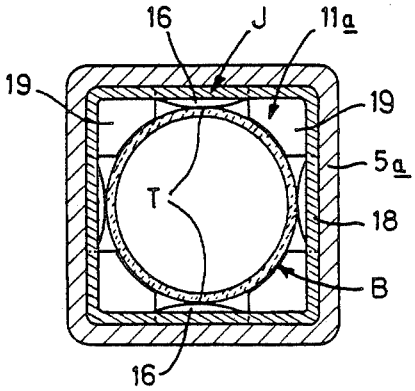
FIG. 7 is a cross-section of the device shown in FIG. 6, mounted on the holder.

When the brake device is assembled (as shown in FIGS. 5 and 7), the casing 5*a* contains flexible friction means R driven by the casing and situated against its inner surface 7*a*. The friction means R are adapted to rub permanently against the outer surface 8 of the sheath 4 constituting the second part, and thus to effect braking.

The casing 5*a* is closed by a cover 13*a* of polygonal shape, which is square in the example envisaged, this cover having a central opening 14*a* permitting the free passage of the sheath 4. The cover 13*a* is generally made of plastics material. The friction means R comprises a skirt J of flexible material extending from the cover 13*a* towards the bottom 10*a* which closes the casing. As shown in FIG. 5, when the device is assembled the skirt J is in contact with the outer surface 8 of the sheath 4 in certain zones T at the central portions of the faces of the casing 5*a*.

The skirt J is composed of a prismatic surface having substantially plane faces parallel to those of the casing 5*a*. In the example envisaged the skirt J has a square contour, like the casing 5*a*, but has smaller dimensions, so that it can go inside this casing. The length l of the skirt J, in a direction parallel to the axis of the casing 5*a*, is substantially greater than the thickness e of the skirt J in the radial direction. The length l is generally greater than five times e ($>5e$).

On its inner surface the skirt J may have radially inwarding projecting swellings such as 16 (FIGS. 6 and 7) situated in the central region of the faces of the skirt J. These swellings are adapted to come into contact in the zones T with the surface of the sheath 4, particularly for the purpose of increasing the braking between the parts.

In the embodiment shown in FIGS. 4 and 5 the cover 13*a* has towards each of its corners feet 15*a* directed towards the bottom 10*a* of the casing and intended to be engaged in the interior of the casing 5*a*. Each foot 15*a* has a section whose shape is substantially that of a right-angled isosceles triangle in which the right angle has been rounded off by an arc of a circle with its convexity facing outwards. The feet 15*a* are oriented at right angles to the centre plane of the cover 13*a*.

The skirt J is composed of a band 17 of flexible material which has a closed contour and is separate from the cover 13*a*, and it is engaged around the feet 15*a* of the cover.

The band 17 is preshaped in such a manner as to have a contour similar to that of the inside section of the casing 5*a*. The preshaped square band 17 can thus be very easily engaged over the feet 15*a*. The band 17 is so constructed as to exert a light grip on the feet of the cover 13*a*.

The band 17 is made of a flexible plastics material, particularly of polyethylene. The cover 13*a* is made of a more rigid plastics material, particularly of ABS (acrylonitrile-butadiene-styrene compolymer). The casing 5*a* may be made of a rigid plastics material, particularly of ABS, or of metal.

Although not shown in FIGS. 4 and 5, the band 17 could also be provided with thickenings, such as beads or swellings, on its inner surface in the central region of the faces, similar to the swellings 16 in FIGS. 6 and 7, in order to increase the braking.

In the embodiment shown in FIGS. 6 and 7 the skirt J is formed by a flexible wall 18 as an integral part of the cover 13*b* so the cover is not provided with the feet shown in FIGS. 4 and 5. The assembly comprising the cover 13*b* (formed by a sort of plate having a square contour) and the skirt J, is an integral moulding. This cover 13*b* has a central opening 14*b* permitting the free passage of the sheath 4 and is made of plastics material, particularly polyethylene.

As previously indicated, radially inwardly projecting swellings or beads 16 are provided on the inner surface of the skirt J in the central region of the faces. These internal beads 16 may be worn away, paricularly when the skirt j is intended for braking against a metal sheath 4.

In these two separate embodiments shown in FIGS. 4 to 7, the casing 5*a* is provided with means 11*a* for locking the first part, (the button 3) relative to the casing 5*a*, these locking means being situated outside the contour of the first part 3 against the inside wall of the casing 5*a* and against the bottom 10*a*.

To be more precise, these locking means 11*a* are bosses 19 provided in the dihedra of the wall of the casing 5*a* and projecting radially inwardly so as to grip the button 3. Each boss 19 has a prismatic shape with a section having substantially the shape of a right-angled triangle whose hypotenuse is replaced by an arc of a curve 20 with its concavity facing radially inwardly. Each boss 19 thus has an inwardly facing part cylindrical surface 21, in this case provided with longitudinally extending ribs adapted to cooperate with complementary grooves on the cylindrical surface of the button 3 in order to fasten the casing 5*a* and the button 3 together for conjoint rotation. The radius of curvature of the cylindrical surface 21 is the same as that of the button 3.

The methods of assembly and operation of the brake device according to the invention are immediately clear from the above explanations.

The button 3 and the bottom portion of the sheath 4 are forced-fitted into the casing 5*a*, between the bosses 19 which grip the button 3 and join it to the casing.

In the case of FIGS. 4 and 5, the band 17 is engaged around the feet 15*a*, which it covers substantially over their entire length. The feet 15*a* and the band 17 are then force-fitted in the casing 5*a*, the corners of the band 17 being gripped between the feet 15*a* and the inside dihedra of the casing 5*a*. In the central regions of these faces the band 17 is gripped between the casing 5*a* and the cylindrical surface of the portion 6 of the sheath 4, thereby producing the desired braking between the parts A and B.

In the case of FIGS. 6 and 7, in which the wall 18 is fixed to the cover 13*b*, assembly is even simpler, because it is sufficient to slide this cover 13*b* so as to insert the wall 18 into the casing 5*a* until the bottom face of the cover 13*b* comes to bear against the edge of the opening in the casing 5*a*.

In order to control the extraction and retraction of the lipstick 2, the sheath 4 is held in one hand and the other hand is used to turn the casing 5*a* relative to the sheath 4 in such a manner as to drive the button 3 rotationally in the desired direction.

During this rotational movement, friction is produced in the four zones of contact T between the skirt J, driven by the casing 5*a*, and the surface 8 of the sheath 4. This friction gives rise to smooth operation comparable to hydraulic sliding.

I claim:

1. A holder for a cosmetic product having first and second substantially coaxially mutually relatively rotatable parts and a braking device operable between said parts wherein the improvement comprises:

(a) said first and second parts have substantially the same diameter as one another and are disposed axially adjacent one another, said second part having an outer surface;

(b) said braking device comprising a casing having an inner portion and a bottom end connected for rotation with said first part and arranged to surround at least a portion of the second part;

(c) said casing containing flexible friction means driven by said casing and situated against said inner portion of said casing;

(d) wherein said first part comprises an operating button for said holder and said second part comprises a sheath for said holder having a base with said casing surrounding said base of said sheath and being situated near said operating button.

2. A braking device for a holder for a cosmetic product of the type having first and second substantially coaxially mutually relatively rotatable parts wherein the improvement comprises:

(a) said first and second parts have substantially the same diameter as one another and are disposed axially adjacent one another, said second part having an outer surface;

(b) said braking device comprising a casing having an inner portion and a bottom end connected for rotation with said first part and arranged to surround at least a portion of the second part;

(c) said casing containing flexible friction means driven by said casing and situated againt said inner portion of said casing;

(d) said friction means being disposed to permanently rub against the outer surface of said second part in at least several zones of contact, said casing having a polygonal contour.

3. A device according to claim 2, including a cover to said casing; and wherein the friction means comprises a skirt of flexible material extending from said cover of the casing towards said bottom of the casing, said skirt being in contact with said outer surface of the second part in several zones.

4. A device according to claim 3, wherein the skirt has a prismatic surface with substantially plane faces which come into contact with the second part.

5. A device according to claim 4, wherein the casing has a generally prismatic shape and has a polygonal contour, and wherein the prismatic surface of the skirt is substantially parallel to the contour of the casing.

6. A device according to claim 3, wherein the skirt has on its inner surface swellings adapted to come into contact with said outer surface of the second part for the purpose of increasing the braking between said first and second parts.

7. A device according to claim 3, wherein the cover has a polygonal shape and is provided towards each of its corners with feet directed towards said bottom of the casing and intended to be situated inside said casing, and wherein the skirt is a band of flexible material having a closed contour and separate from the cover, said band being disposed around the feet of the cover.

8. A device according to claim 3, wherein the skirt is integrally moulded with the cover.

9. A device according to claim 3, wherein the casing has a transverse bottom and means for locking the first part relative to the casing, said locking means being situated outside the contour of the first part against the internal wall of the casing.

10. A device according to claim 9, wherein said casing has a polygonal contour and a prismatic shape, and wherein the locking means consist of bosses disposed in the dihedra of the side walls of the casing and projecting radially inwards in order to grip the first part.

11. A braking device for a holder for a cosmetic product of the type having first and second substantially coaxially mutually relatively rotatable parts wherein the improvement comprises:

(a) said first and second parts have substantially the same diameter as one another and are disposed axially adjacent one another, said second part having an outer surface;

(b) said braking device comprising a casing having an inner portion and a bottom end connected for rotation with said first part and arranged to surround at least a portion of the second part;

(c) said casing containing flexible friction means driven by said casing and situated against said inner portion of said casing;

(d) said casing being in the form of a polygon and said flexible friction means comprising an elastic belt extending over the perimeter of said polygon and in contact with said outer surface of said second part in several zones of contact.

12. A device according to claim 11, wherein the elastic belt is an elastic O-ring.

13. A device according to claim 12, wherein the O-ring is made of elastomeric material.

14. A device according to claim 11, wherein said first and second parts have a circular cross-section, and the casing has a square cross-section with an inner surface, the inner edge of the elastic belt extending substantially over the square circumscribed on said circular cross-section of the second part, and the outer edge of said elastic ring bearing against the inner surface of the square cross-section of the casing.

15. A device according to claim 11, said polygon including apices mounting means situated at the apices of said polygon and disposed inside the casing, said elastic belt being engaged around these mounting means.

16. A braking device for a holder for a cosmetic product of the type having first and second substantially coaxially mutually relatively rotatable parts wherein the improvement comprises:

(a) said first and second parts have substantailly the same diameter as one another and are disposed axially adjacent one another, said second part having an outer surface;

(b) said braking device comprising a casing having an inner portion and a bottom end connected for rotation with said first part and arranged to surround at least a portion of the second part;

(c) said casing containing flexible friction means driven by said casing and situated against said inner portion of said casing;

(d) said casing being closed by a cover, said cover including means defining an opening for the passage of said second part, said cover being provided towards each of its corners with feet directed toward said bottom of the casing and intended to be situated inside the casing, said feet constituting mounting means for an elastic belt and said friction means comprising an elastic belt passed around said feet.

17. A device according to claim 16, wherein said cover is polygonal.

18. A braking device for a holder for a cosmetic product of the type having first and second substantially coaxially mutually relatively rotatable parts wherein the improvement comprises:

(a) said first and second parts have substantially the same diameter as one another and are disposed axially adjacent one another, said second part having an outer surface;

(b) said braking device comprising a casing having an inner portion and a bottom end connected for rotation with said first part and arranged to surround at least a portion of the second part;

(c) said casing containing flexible friction means driven by said casing and situated against said inner portion of said casing;

(d) said device further including means defining a socket in said first part and said casing having an axis, wherein the bottom of the casing is provided internally with a funnel extending parallel to the axis of the casing and disposed to be engaged in said socket in said first part in order to connect said casing for conjoint rotation with said first part, and wherein said casing has a side wall adapted to surround completely said portion of said second part.

* * * * *